US011142961B2

(12) United States Patent
Elbadawy

(10) Patent No.: US 11,142,961 B2
(45) **Date of Patent: *Oct. 12, 2021**

(54) METHODS AND SYSTEMS FOR REDUCING DRAG AND FRICTION DURING DRILLING

(71) Applicant: O&G Technologies LLC, Katy, TX (US)

(72) Inventor: Hossam Elbadawy, Katy, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/596,962

(22) Filed: Oct. 9, 2019

(65) Prior Publication Data

US 2020/0040669 A1 Feb. 6, 2020

Related U.S. Application Data

(63) Continuation of application No. PCT/US2018/049012, filed on Aug. 31, 2018, which is a continuation of application No. 15/694,078, filed on Sep. 1, 2017, now Pat. No. 10,472,902.

(51) Int. Cl.

| | |
|---|---|
| ***E21B 17/05*** | (2006.01) |
| ***E21B 17/08*** | (2006.01) |
| ***E21B 17/042*** | (2006.01) |
| ***E21B 17/10*** | (2006.01) |
| ***E21B 17/18*** | (2006.01) |

(52) U.S. Cl.
CPC ..... *E21B 17/05* (2013.01); *E21B 17/042* (2013.01); *E21B 17/08* (2013.01); *E21B 17/1078* (2013.01); *E21B 17/18* (2013.01)

(58) Field of Classification Search
CPC ..... E21B 17/05; E21B 17/08; E21B 17/042; E21B 17/1078; E21B 17/18
See application file for complete search history.

(56) References Cited

U.S. PATENT DOCUMENTS

| | | | | |
|---|---|---|---|---|
| 1,699,087 | A * | 1/1929 | Woodmansee | E21B 17/1057 166/241.3 |
| 1,877,395 | A * | 9/1932 | Goeser | E21B 17/1064 175/325.3 |
| 10,472,902 | B2 * | 11/2019 | Elbadawy | E21B 17/18 |
| 2005/0092527 | A1 * | 5/2005 | Le | E21B 17/1007 175/325.6 |

* cited by examiner

*Primary Examiner* — Brad Harcourt
(74) *Attorney, Agent, or Firm* — Pierson IP, PLLC

(57) ABSTRACT

A rotating flow coupler that is configured to couple multiple sections of a casing for a horizontal well, wherein the rotating flow coupler is configured to rotate relative to the casing allowing an additional degree of freedom for equipment being lowered into the well. This may allow for equipment such as coil tubing, drilling string, casings strings, etc. to reach a total distance of deeper laterals.

20 Claims, 5 Drawing Sheets

200

START
COUPLE FIRST FLOW COUPLER TO FIRST AND SECOND SECTIONS OF CASING
210
COUPLE SECOND FLOW COUPLER TO SECOND SECTION AND THIRD SECTIONS OF CASING
220
CEMENT OUTER TOOL TO BOREHOLE
230
ROTATE INNER TOOL OF FIRST FLOW COUPLER
240
LOAD DISTRIBUTION DYNAMICALLY CHANGE
250
CREST AND TROUGHS OF CASING CHANGE
260
ROTATE INNER TOOL OF SECOND FLOW COUPLER
270
END

METHODS AND SYSTEMS FOR REDUCING DRAG AND FRICTION DURING DRILLING

BACKGROUND INFORMATION

Field of the Disclosure

Examples of the present disclosure relate methods and systems for reducing drag and friction during drilling. More specifically, embodiments include a rotating flow coupler coupling portions of casing together, wherein the rotating flow coupler includes a bearing that rotates to allow for equipment to extend around a casing shoe.

Background

Directional drilling is the practice of drilling non-vertical wells. Horizontal wells tend to be significantly more productive than vertical wells because they allow a single well to reach multiple points across a horizontal axis without the need for additional vertical wells. This makes each individual well more productive by being able to reach reservoirs across the horizontal axis. While horizontal wells are more productive than conventional wells, horizontal wells are more costly.

Horizontal wells are initially created by drilling a primary vertical shaft. Then, horizontal wells are situated from the primary vertical shaft. However, when creating horizontal wells, a ratio between a lateral length and the vertical distance from a point in the well increases. As the ratio increases, additional drag and friction potentially prevent equipment from reaching the total depth of the well. More so, the drag and friction forces significantly reduce the drill string (drill string, coil tubing, the next casing string and the completion string) ability to reach the total depth of the well.

For certain equipment to reach the total depth of the well, conventional systems utilize chemical lubricants, roller beads, vibration, etc. However, these solutions work until a certain lateral length after that the additional drag and friction could lead to buckling of the equipment being positioned within the well. This potentially prevents the equipment from reaching the total depth.

Accordingly, needs exist for system and methods utilizing a bearing in a rotating flow coupler or a group of casing joints allowing for additional degrees of freedom, which allows equipment to be rotated around a critical section of a wellbore, inside the casing and around the horizontal section kick off point to reduce the drag and friction.

SUMMARY

Embodiments disclosed herein describe a rotating flow coupler that is configured to couple multiple sections of a casing for a horizontal well, wherein the rotating flow coupler is configured to rotate relative to the casing allowing an additional degree of freedom for equipment being lowered into the well. This may allow for equipment such as coil tubing, drilling string, casings strings, etc. to reach a total distance of deeper laterals. Embodiments of may include casing, crossovers, and a flow coupler.

The casing may be configured to be installed into a well before other tools or equipment is run into the well. The casing may include a channel, passageway, conduit extending from a proximal end of the casing to a distal end of the casing. The casing may be a large diameter pipe that is assembled and inserted into a recently drilled section of a borehole. The casing may be held in place by cement being positioned in a first annulus between an outer diameter of the casing and the borehole. In embodiments, a well may include many different sections of casing that are separated by different flow couplers. The distal and proximal ends of the casing may be configured to interface with and be connected with the crossovers and/or flow couplers. In further embodiments, the casing may include an inner casing and an outer casing, wherein a second annulus is positioned between the inner and outer casing.

The crossovers may be short subassemblies that are configured to enable two components with different thread types or sizes to be connected. The crossovers may also be configured to give flexibility to have a standard rotating flow coupler with casing strings with different thread types, wherein the crossovers may be configured to be utilized with different types of threads. In embodiments, a first crossover may be configured to couple with a first portion of the casing and an inner tool of the flow coupler. A second crossover may be configured to couple with a second portion of the casing and an outer tool of the flow coupler.

The rotating flow coupler may include an inner tool, outer tool, threaded sleeve, seal, first bearing, and second bearing. The inner tool may be configured to rotate in relation to the outer tool to provide an additional degree of freedom for equipment passing through the casing. Furthermore, the inner tool may be dynamically and continuously rotated based on a load applied to different sections of the casing. In embodiments, a first diameter across the inner tool may be substantially similar to that of the casing. The outer tool may be configured to be cemented to the borehole, and fixed in place.

The threaded sleeve may be configured to be positioned between the inner tool and the outer tool, and couple the inner tool and the outer tool. The threaded sleeve may have a first end that is positioned on an outer surface of the inner tool, and have a second end that is configured to be threaded into an inner surface of the outer tool.

The seal may be configured to seal, isolate, restrict, etc. fluid from flowing in an annulus between the inner tool and the outer tool.

The bearings may be configured to be positioned between the inner tool and the outer tool, and allow for relative rotation between the inner tool and the outer tool. Specifically, the bearings may be configured to allow the inner tool to rotate around a fixed axis, while the outer tool remains fixed in place. The bearings may be any type of bearings including mechanical bearings, fluid bearings, magnetic bearings, etc. In embodiments, the bearings may be separated by a shoulder extending from the outer tool to the inner tool. The shoulder may be configured to receive loads from the bearings, allowing the relative rotation of the inner tool. In further embodiments, the shoulder may extend from the inner tool to the outer tool, wherein the bearings are separated by the shoulder.

In embodiments, by allowing the relative rotating of the inner tool and the casing, an additional degree of freedom for equipment being lowered in the well may be created. Furthermore, embodiments of the rotating flow coupler may be retrofitted to existing flow couplers, allowing equipment to reach deeper laterals in a well.

Embodiments may also include a segmented casing, wherein a single length of outer casing may be segmented into multiple parts through the inner casings that may be individually rotated. Embodiments may include additional bearing between the segments of outer casing that allows for the rotation of the segments. There may be seals positioned between the segments of the inner casings to isolate an annular area between the segments from the borehole. Additionally, there may be seals between the individual segments of the inner casing and the outer casing. In embodiments, different segments of the inner casings may be independently rotated with different angular velocities.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
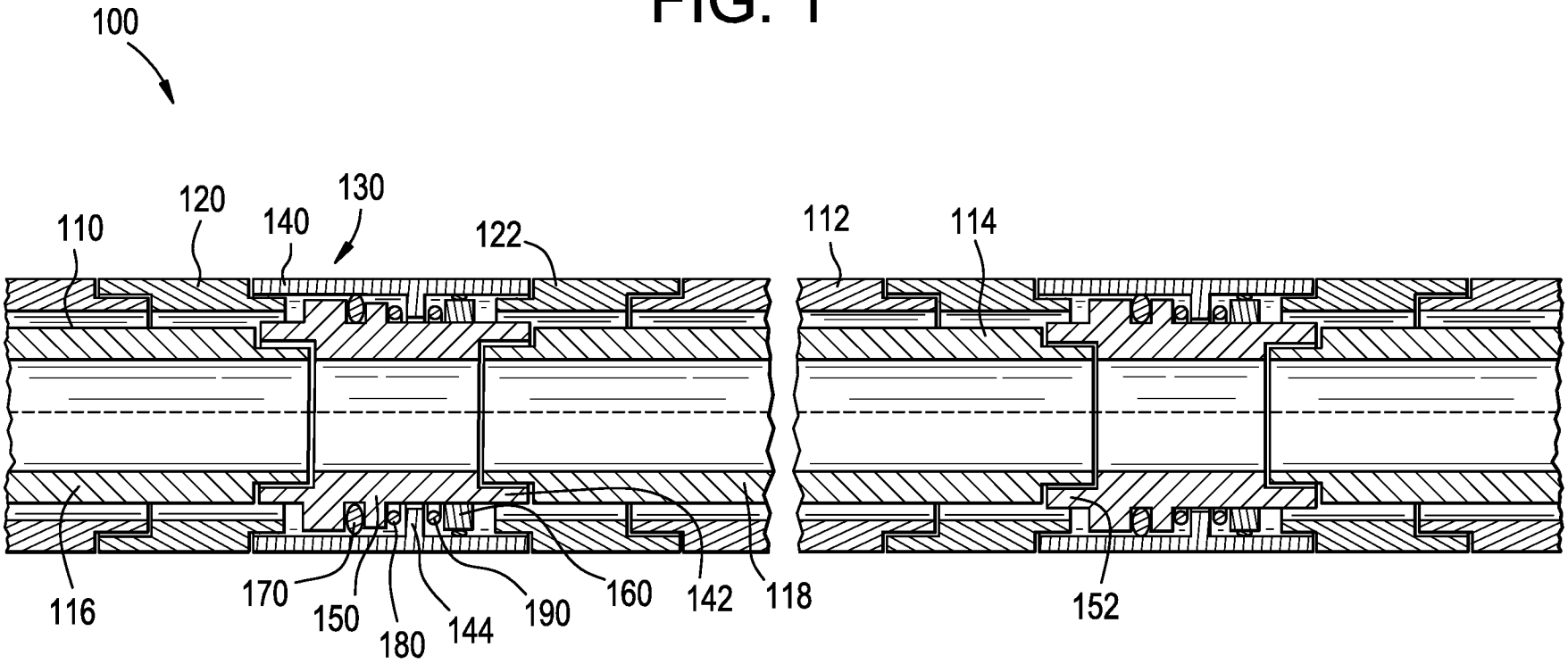
FIG. 1 depicts a system utilizing a plurality of rotating flow couplers that are configured to couple multiple sections of a casing of a horizontal well.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

FIG. 1 depicts a system 100 utilizing a plurality of flow couplers 130 that are configured to couple multiple sections of a casing 110 of a well. System 100 may include casing 110, crossovers 120, and flow couplers 130.

Casing 110 may be a large diameter pipe that is assembled and inserted into a recently drilled section. Casing 110 may be configured to be installed into a well before other tools or equipment is run into the well. Casing 110 may include a channel, passageway, conduit, etc. extending from a proximal end of casing 110 to a distal end of casing 110. In embodiments, a well may include many different sections of casing 110, which may be separated by a different rotating flow coupler 130. The distal and proximal ends of each section of casing 110 may be configured to interface with and/or be connected with crossovers 120 and/or flow couplers 130. In embodiments, sections of casing 110 between flow couplers 130 may have crests and troughs, which may be positioned adjacent to the sidewalls of the borehole or away from the sidewalls of the borehole.

In embodiments, casing 110 may include an outer casing 112 and an inner casing 114, wherein outer casing 112 is positioned adjacent to the sidewalls of the boreholes and inner casing 114 is configured to rotate responsive to rotating flow couplers 130 rotating. Casing 112 may be held in place by cement being positioned between an outer diameter of casing 112 and the borehole. In embodiments, casing 112 and casing 114 may be fully independent casings, wherein casing 112 and casing 114 may be different sized and/or shaped casings.

Crossovers 120 may be short subassemblies that are configured to enable two components (i.e. casing 110 and flow couplers 130) to be interconnected. A first crossover 122 may be configured to couple with a first portion of the casing 112 and an outer tool 140 of rotating flow coupler 130. In embodiments, crossovers 120 may include a grooves, projections, etc. that are configured to receive corresponding grooves, projections, etc. on casing 110 and/or flow couplers 130. This may enable the corresponding grooves and projections to be overlaid to allow the components to be connected, which may for a continuous hollow chamber through system 100.

Rotating flow couplers 130 may be a device that is configured to couple multiple sections of casing 110 together, and rotate to allow for an additional degree of freedom for equipment being lowered into a well. In embodiments, rotating flow couplers 130 may be configured to act as centralizer to the casing 110 in the well bore, which should help the cementing process. This may be beneficial when installing or replacing a section of system 100. Flow couplers 130 may include an outer tool 140, inner tool 150, threaded sleeve 160, seal 170, first bearing 180, and second bearing 190.

Outer tool 140 may have an outer diameter that is configured to be positioned adjacent to a borehole, wherein the outer diameter is configured to be held in place by cement within the borehole. In embodiments, the cement may be utilized to hold outer tool 140 and outer casing 112 in place, while allowing for the relative rotation of inner tool 150 and inner casing 116. Outer tool 140 may include interface projections 142 and shoulder 144.

Interface projections 142 may be configured to interface with corresponding grooves on crossovers 120 to couple outer tool 140 with the crossovers 120.

Shoulder 144 may be a projection extending from an inner diameter of outer tool 140 towards the outer diameter of inner tool 150. Sidewalls associated with shoulder 144 may be configured to receive loads from first bearing 180 and second bearing 190, which may allow for the relative rotation of inner tool 150.

Inner tool 150 may be positioned adjacent to outer tool 140 in a position that is more proximate to a longitudinal axis of system 100 than outer tool 140. Inner tool 150 may have a diameter that is substantially similar to that of casing 114 throughout system 100. This may allow for seamless transition between different sections of casing 114, which may be positioned on opposite ends of inner tool 150. Inner tool 150 may be configured to rotate around an axis substantially similar to the longitudinal axis of system 100, while outer tool 140 may remain fixed in place. In embodiments, as loads are applied to system 100 at different locations while equipment is being positioned down well, inner tool 150 may dynamically and continuously rotate. As such, inner tool 150 may not be locked in place, which may limit the buckling or strain of drill string, coil tubing, etc. within system 100. Moreover, rotating inner tool 150, once installed and installed in place, may be stationary except for free axial rotation around the longitudinal axis of the casing 110. As inner tool 150 rotates, a first section 116 of casing 114 and a second section 118 of casing 114 may simultaneously rotate. Furthermore, as any section of casing 114 rotates, other sections of casing 114 may also simultaneously be rotated. This may enable casing 110 to have portions with a curved axis to create a horizontal well. As such, portions of inner tool 150 may be configured to rotate about a curved axis.

Additionally, inner tool 150 may include interface projections 152. Interface projections 152 may be configured to interface with corresponding grooves on inner casing 114 to couple the elements together. In embodiments, there may be seals positioned between inner tool 150 and inner casing 114, wherein the seals are configured to isolate an annulus from an inner flow conduit. Further, a first end of inner casing 114 may be connected to a flow coupler 150, while a second end of inner casing 114 may be supported within a crossover or outer casing 112.

Threaded sleeve 160 may be positioned between inner tool 150 and outer tool 140, and couple inner tool 150 with outer tool 140. Threaded sleeve 160 may have a first end that is positioned on an outer surface of inner tool 150, and a second end that is configured to be threaded into an inner surface of outer tool 140. Furthermore, threaded sleeve 160 may be configured to operate as a seal. Accordingly, inner tool 150 and outer tool 140 may be separate elements that can be coupled together during the formation of system, which may occur down well or above ground.

Seal 170 may be configured to seal, isolate, restrict, etc. fluid or other objects from flowing between inner tool 150 and outer tool 140. Seal 170 may be positioned proximate to a distal end of seal 170. Accordingly, rotating flow coupler 150 may include two seals, seal 170 and threaded sleeve 160.

First bearing 180 and second bearing 190 may be positioned between inner tool 150 and outer tool 140. First bearing 180 and second bearing 190 may be configured to allow for the relative rotation between inner tool 150 and outer tool 140. Specifically, first bearing 180 and second bearing 190 may be configured to allow inner tool 150 to rotate around a fixed axis, while allowing outer tool 140 to be fixed in place. Bearings 180, 190 may be any type of bearings including mechanical bearings, fluid bearings, magnetic bearings, etc. In embodiments, the bearings 180, 190 may be separated by shoulder 144 extending from outer tool 140 towards inner tool 150, wherein shoulder 144 is configured to receive loads from bearings 180, 190 to allow the relative rotation of inner tool 150.

Figure 2:
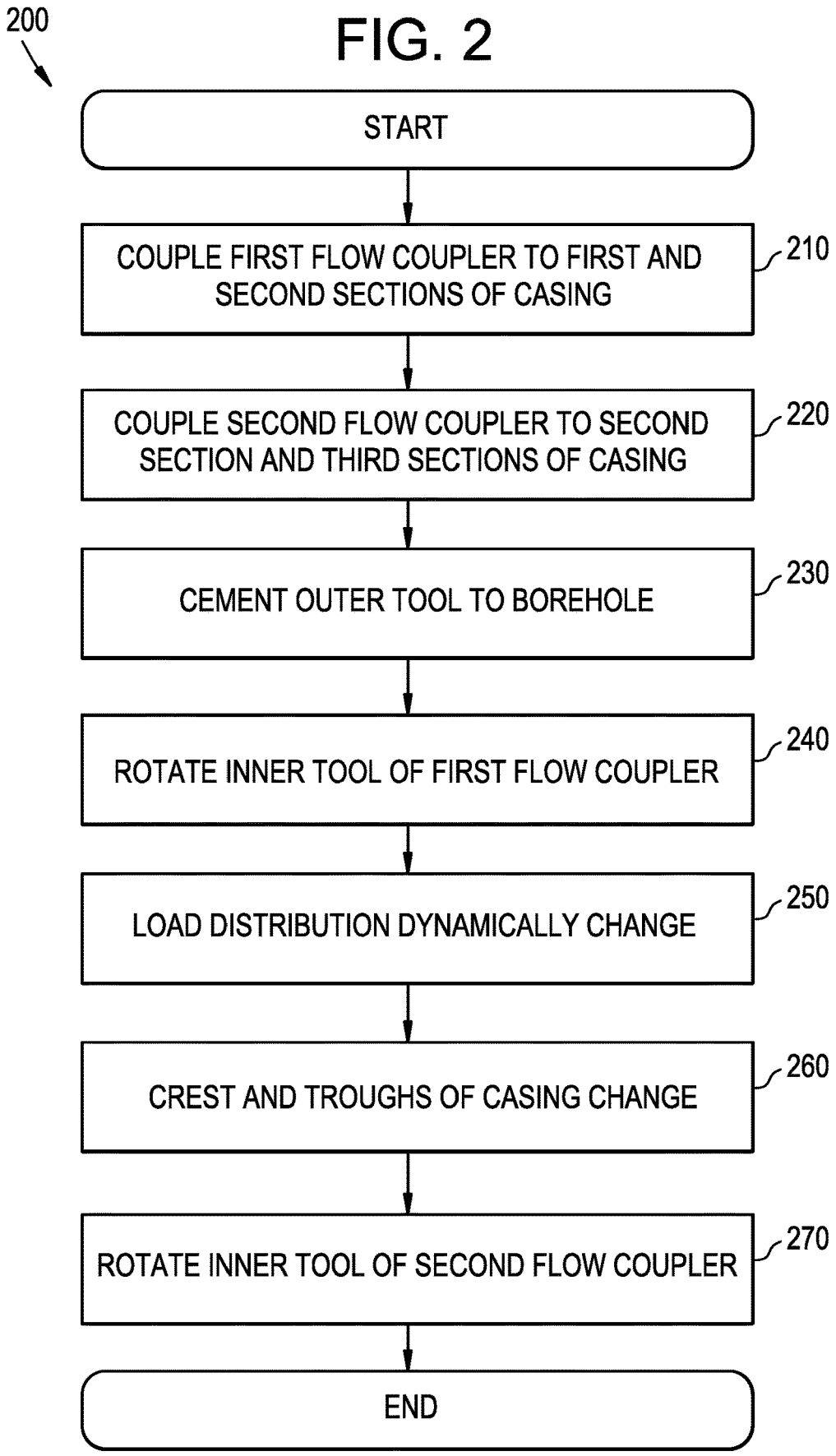
FIG. 2 depicts a phases of a method for allowing an additional degree of freedom for equipment being lowered in a well.

FIG. 2 depicts a phases of a method 200 for allowing an additional degree of freedom for equipment being lowered in a well. The operations of the method depicted in FIG. 2 are intended to be illustrative. In some embodiments, the method may be accomplished with one or more additional operations not described, and/or without one or more of the operations discussed. Additionally, the order in which the operations of the method are illustrated in FIG. 2 and described below is not intended to be limiting. Elements depicted in FIG. 2 may be described above. For the sake of brevity, a further description of these elements is omitted.

At operation 210, a first rotating flow coupler may be coupled to a first section of casing and a second section of casing. The first rotating flow coupler may include an inner and outer tool, wherein the inner tool is configured to rotate with respect to a longitudinal axis of the first flow coupler.

At operation 220, a second rotating flow coupler may be coupled to the second section of casing and a third section of casing.

At operation 230, the outer diameter of the outer tool of first rotating flow coupler and the second rotating flow coupler may be coupled or cemented to sidewalls of a borehole. This may allow the outer diameter of the first and second flow couplers to remain fixed in place.

At operation 240, the inner tool of the first rotating flow coupler may rotate around a longitudinal axis of the first flow coupler.

At operation 250, responsive to the inner tool of the first rotating flow coupler rotating, loads applied to different sections of the casings may change. As the different sections of casing have different crests and troughs, the distribution of loads to the different sections of the drill string, coil tubing, etc. may vary. This may cause waves within the different sections of drill string, coil tubing, etc., and offsets between the longitudinal axis of the different sections of the drill string, coil tubing, etc.

At operation 260, responsive to the loads applied to the second and third section of drill string, coil tubing, etc. changing, the crests and troughs of the second and third section of the drill string, coil tubing, etc. may change.

At operation 270, the inner tool of the second rotating flow coupler may rotate around a longitudinal axis of the second rotating flow coupler based on the change in load, wherein the longitudinal axis of the first and second flow couplers may not be positioned in parallel to each other. This may allow the first and the third second of the drill string, coil tubing, etc. to rotate around axis that are not in parallel to each other.

Figure 3:
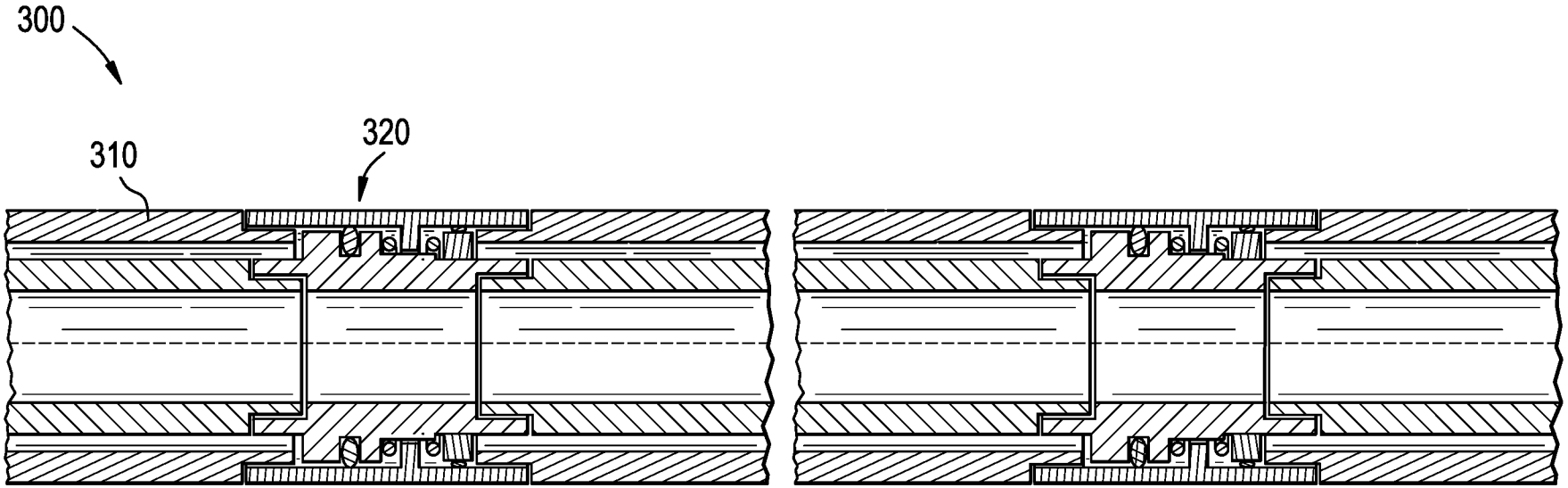
FIG. 3 depicts a system utilizing a plurality of rotating flow couplers that are configured to couple multiple sections of a casing of a horizontal well.

FIG. 3 depicts a system 300 utilizing a plurality of flow couplers 320 that are configured to couple multiple sections of a casing 310 of a horizontal well. Elements depicts in FIG. 3 may be substantially described above. For the sake of brevity, another description of these elements is omitted.

As depicted in FIG. 3, flow couplers 320 may be directly coupled to casing 310 without the use of crossovers. This may simplify the process of creating system 300 by embedding grooves, overhangs, interfaces, etc. within flow couplers 320 and casing 310.

Figure 4:
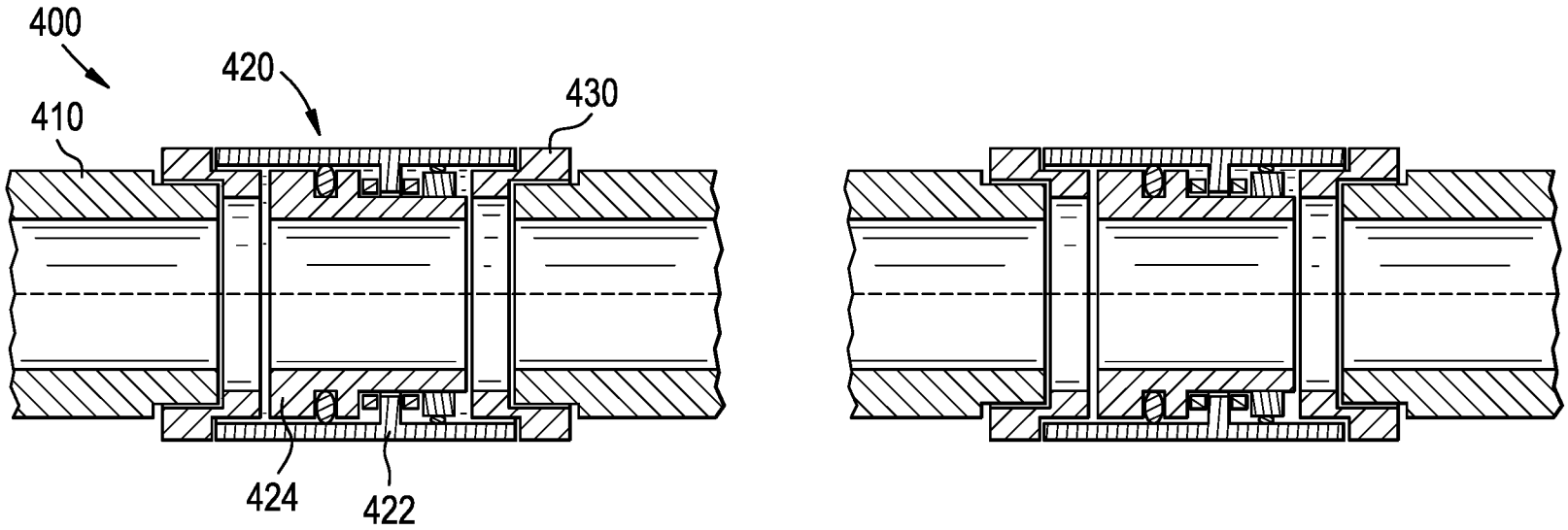
FIG. 4 depicts a system utilizing a plurality of rotating flow couplers that are configured to couple multiple sections of a casing of a horizontal well.

FIG. 4 depicts a system 400 utilizing a plurality of flow couplers 420 that are configured to couple multiple sections of a casing 410 of a horizontal well. Elements depicts in FIG. 4 may be substantially described above. For the sake of brevity, another description of these elements is omitted.

As depicted in FIG. 4, casing 410 may only include a single section that is coupled to outer tool 422 via crossover 430. Furthermore, casing 410 may not be directly coupled to inner tool 424. However, inner tool 424 may be configured to freely rotate while outer tool 422 is cemented to the borehole. Furthermore, inner tool 424 may have the same diameter as that as casing 410. Yet, outer tool 422 may have a larger outer diameter than that as casing 410. Additionally, inner tool 424 may have a same, smaller, or larger inner diameter than that of casing 410.

Figure 5:
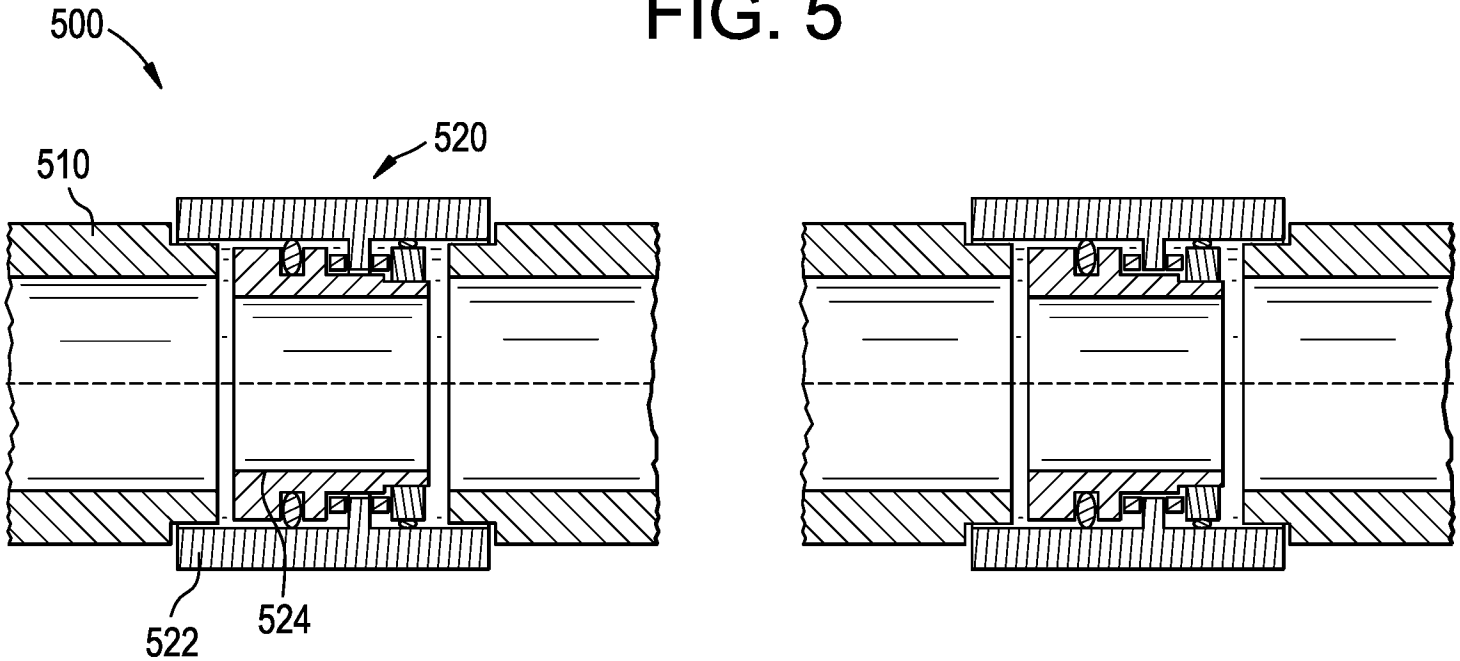
FIG. 5 depicts a system utilizing a plurality of rotating flow couplers that are configured to couple multiple sections of a casing of a horizontal well.

FIG. 5 depicts a system 500 utilizing a plurality of flow couplers 520 that are configured to couple multiple sections of a casing 510 of a horizontal well. Elements depicts in FIG. 5 may be substantially described above. For the sake of brevity, another description of these elements is omitted.

As depicted in FIG. 5, outer tool 522 may be directly coupled to casing 510. Furthermore, outer tool 522 may have a greater outer diameter than that of casing 510, and inner tool 522 may have a smaller inner diameter than that of casing 510. This may allow for different positioning of loads throughout system 500 by rotating inner tool 524, and allowing flexing of drill string, coil tubing, etc. 510 in different positions. In different embodiments, the length of inner tool 524 may be different based on the application of the system.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

The invention claimed is:

1. A rotating flow coupler comprising:

an outer tool positioned between a first casing element and a second casing element, the outer tool being configured to be fixed in place against a borehole;

an inner tool being configured to be positioned adjacent to an inner diameter of the outer tool, the inner tool being configured to rotate relative to the outer tool while the outer tool is fixed in place, wherein the inner tool is positioned between the first casing element and the second casing element.

2. The rotating flow coupler of claim 1, wherein an outer circumference of the outer tool is positioned proximate to sidewalls of a borehole.

3. The rotating flow coupler of claim 1, further comprising:

a seal positioned between the inner tool and the outer tool, the seal being configured to restrict fluid from flowing in-between the inner tool and the outer tool.

4. The rotating flow coupler of claim 1, further comprising:

a bearing configured to allow the inner tool to rotate independently from rotation of the outer tool.

5. The rotating flow coupler of claim 1, wherein the outer tool is longitudinally aligned with the inner tool within a wellbore.

6. A rotating flow coupler comprising:

an outer tool positioned between a first casing element and a second casing element;

an inner tool configured to be positioned adjacent to an inner diameter of the outer tool, the inner tool configured to rotate relative to the outer tool, wherein the inner tool is positioned between the first casing element and the second casing element, the first casing element includes an inner casing and an outer casing.

7. The rotating flow coupler of claim 6, further comprising:

a first crossover being configured to couple the outer casing and the outer tool.

8. The rotating flow coupler of claim 6, wherein the outer casing is directly coupled to the outer tool.

9. The rotating flow coupler of claim 8, wherein the inner casing is directly coupled with the inner tool.

10. The rotating flow coupler of claim 6, wherein a first diameter across the inner casing is related to a second diameter across the inner tool.

11. A method associated with a rotating flow coupler comprising:

positioning an outer tool between a first casing element and a second casing element;

cementing the outer tool against a borehole to fix the outer tool in place;

rotating the inner tool relative to the outer tool when the outer tool is fixed in place against the borehole, wherein the inner tool is coupled to an inner diameter of the outer tool, wherein the inner tool is positioned between the first casing element and the second casing element.

12. The method of claim 11, wherein an outer circumference of the outer tool is positioned proximate to sidewalls of a borehole.

13. The method of claim 11, further comprising:

positioning a seal between the inner tool and the outer tool to restrict fluid from flowing in-between the inner tool and the outer tool.

14. The method of claim 11, further comprising:

positioning a bearing between the inner tool and the outer tool to allow the inner tool to rotate independently from rotation of the outer tool.

15. The method of claim 11, further comprising:

longitudinally aligning the outer tool and the inner tool within a wellbore.

16. The method of claim 11, wherein the first casing element includes an inner casing and an outer casing.

17. The method of claim 16, further comprising:

coupling the outer casing and the outer tool via a first crossover.

18. The method of claim 16, wherein the outer casing is directly coupled to the outer tool.

19. The method of claim 18, wherein the inner casing is directly coupled with the inner tool.

20. The method of claim 16, wherein a first diameter across the inner casing is related to a second diameter across the inner tool.

* * * * *